US005697872A

United States Patent [19]

Stronsick, Jr. et al.

[11] Patent Number: 5,697,872

[45] Date of Patent: Dec. 16, 1997

[54] MARTIAL ARTS TRAINING DEVICE

[76] Inventors: Joseph Stronsick, Jr.; Edward A. Stronsick, both of 13465 Royalton Rd., Strongsville, Ohio 44136

[21] Appl. No.: 640,063

[22] Filed: Apr. 30, 1996

[51] Int. Cl.[6] ..... A63B 69/00

[52] U.S. Cl. ..... 482/83; 482/87; 482/90

[58] Field of Search ..... 43/5; 124/20.1; 482/83–90

[56] References Cited

U.S. PATENT DOCUMENTS

| | | | |
|---|---|---|---|
| 4,572,504 | 2/1986 | DiBartolo | 482/83 |
| 5,183,450 | 2/1993 | Stelmack | 482/83 |
| 5,281,191 | 1/1994 | DeSousa | 482/87 |

FOREIGN PATENT DOCUMENTS

| | | | |
|---|---|---|---|
| 28766 | of 1910 | United Kingdom | 43/5 |
| 181906 | 6/1922 | United Kingdom | 43/5 |
| 2067082 | 7/1981 | United Kingdom | 124/20.1 |

*Primary Examiner*—Jerome Donnolly

*Attorney, Agent, or Firm*—Benesch, Friedlander, Coplan & Aronoff

[57] ABSTRACT

This invention is directed to a martial arts training device useful for developing skill in the martial arts by providing simulated arms and legs for practicing various martial arts techniques. The training device comprises an elongated tubular member having a first and second distal portions, wherein the tubular member has a first arcuate bend adapted to matingly engage an exterior of an associated, generally cylindrical heavy bag so as to engage at least a portion of the bag along a circumference thereof; an elongated elastomeric member having opposed ends fixed to the tubular member on opposite sides of the first arcuate bend so as to define an aperture therewith, whereby the elastomeric member is adapted to secure the tubular member about the bag by securing the bag via friction to the first arcuate bend; and a resilient cover disposed about at least a portion of the elongated tubular member.

20 Claims, 2 Drawing Sheets

MARTIAL ARTS TRAINING DEVICE

BACKGROUND OF THE INVENTION

This invention relates to athletic type training devices and in particular, to training devices and methods useful for the martial arts, boxing, wrestling and physical fitness in general. More particularly, this invention relates to training devices useful for developing skill in the martial arts and boxing by providing simulated arms and legs for practicing various martial arts and boxing techniques.

Martial arts and boxing training involves, among other things, developing the ability to effectively strike an opponent and at the same time to be aware of and respond to strikes or attempted strikes by the opponent. When practicing martial arts or boxing with a live opponent blows often must be performed at partial speed or pulled to prevent injury to the opponent, as full contact with a live opponent may result in injury. The potential of injury to or from a live opponent exists even though each party attempts to moderate or simulate blows.

It is therefore common practice in martial arts and boxing training to practice blows without the benefit of an opponent. A disadvantage of practicing with no opponent is that it is extremely difficult to simulate the presence of an opponent, especially the bobbing and weaving and other realistic movements an opponent is likely to make. Therefore, a need exists for some means to permit a follower of the martial arts or boxing to practice with a simulated opponent. Such a simulated opponent would have specific advantages over the usual method of practice, without an opponent, which approximates shadow boxing.

Numerous martial arts or boxing hitting devices used to train students in the proper method of striking an opponent are known. Such striking devices include punching bags, striking bag platforms, simulated leg kicking devices, and other hitting surfaces. While many of these hitting devices operate reasonably well and generally achieve their objectives under the limited range of operating conditions for which they were designed, such devices have several disadvantages which make them less than optimal training devices. These devices often tend to be bulky, expensive, complicated, or ineffective. Oftentimes, the assistance of another person is required to stabilize and hold the target. This requirement not only increases the difficulty in scheduling workout sessions, but also exposes the person holding the device to injury. Also, many of these devices will not reset or restore to their original condition after each hit, nor are they adjustable to accommodate a wide range of hitting heights. Perhaps most important, these devices do not simulate human movements, such as ducking, hitting, feinting and the like. Consequently, a need exists for a training device and method which is participant-operated, safe to use, portable and realistic in its movements.

The subject invention overcomes the above limitations and others, and teaches a martial arts, boxing and physical fitness training device which provides simulated arms and legs for practicing various martial arts techniques and which is participant-operated, safe to use, portable and realistic in its simulation of human movement.

SUMMARY OF THE INVENTION

In accordance with the present invention, there is provided a martial arts training device which provides simulated arms and legs for practicing martial arts techniques.

Further in accordance with the present invention, there is provided a martial arts training device which is participant-operated, safe to use, portable and realistic in its movements.

Still further in accordance with the present invention, there is provided a martial arts training device, wherein the training device comprises:

an elongated tubular member having a first and second distal portions, wherein the tubular member has a first arcuate bend adapted to matingly engage an exterior of an associated, generally cylindrical heavy bag so as to engage at least a portion of the bag along a circumference thereof;

an elongated elastomeric member having opposed ends fixed to the tubular member on opposite sides of the first arcuate bend so as to define an aperture therewith, whereby the elastomeric member is adapted to secure the tubular member about the bag by securing the bag via friction to the first arcuate bend; and a resilient cover disposed about at least a portion of the elongated tubular member.

Still further in accordance with the present invention, there is provided a martial arts training method, wherein the method comprising:

selectively contacting a resilient cover of an elongated tubular member having first and second distal portions, wherein the tubular member has a first arcuate bend matingly engaged to an exterior of an associated, generally cylindrical heavy bag so as to engage at least a portion of the bag along a circumference thereof, and wherein the tubular member has an elongated elastomeric member having opposed ends fixed to the tubular member on opposite sides of the first arcuate bend so as to define an aperture therewith, whereby the elastomeric member secures the tubular member about the bag by securing the bag via friction to the first arcuate bend so as to minimize relative movement between the bag and the tubular member upon such contact.

One advantage of the present invention is that it provides those training in the martial arts, boxing, or wrestling simulated arms and legs with which to sharpen kicking and punching skills and increases the quality of their training.

A further advantage of the present invention is that the invention is participant-operated allowing the participant to train without the assistance of another person.

A still further advantage of the present invention is that the present invention is safe to use, portable and realistic in its simulation of human movement.

These and other advantages and benefits of the invention will be apparent to those skilled in the art upon a reading and understanding of the following detailed description.

BRIEF DESCRIPTION OF THE DRAWINGS

The subject invention will be described with certain parts, and arrangements of parts in the accompanying drawings which form a part hereof and wherein.

DETAILED DESCRIPTION OF THE PREFERRED EMBODIMENTS

Figure 1:
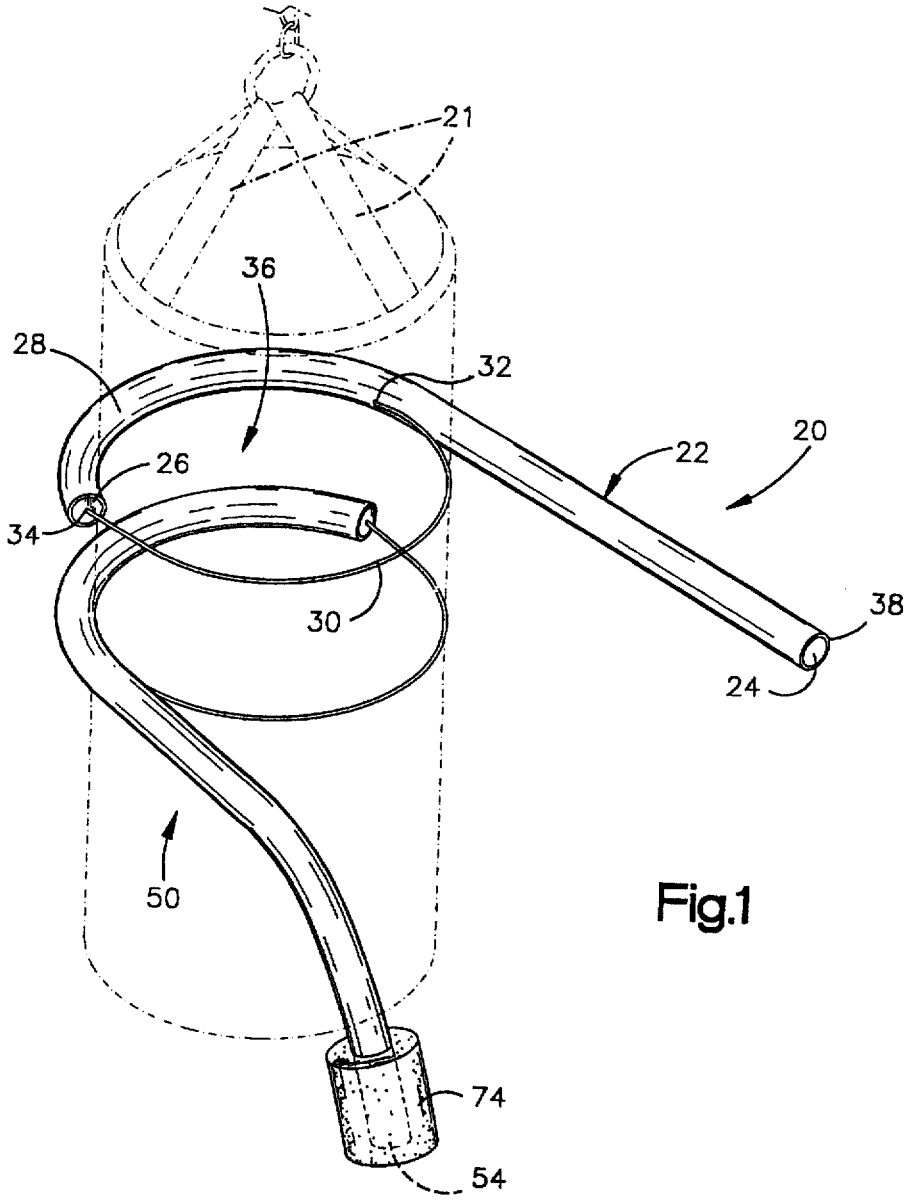
FIG. 1 is a perspective view of a training device according to the present invention as used in connection with a heavy bag.

This invention is directed to a martial arts, boxing and physical fitness training device and methods of use for training in the martial arts and boxing. FIG. 1 is a perspective view of the training device of a preferred embodiment of the present invention. FIG. 1 shows training devices 20 and 50 which are secured to a generally cylindrical heavy bag 10. The heavy bag 10 is of the type that is customarily found in gymnasiums, usually about 1½ feet by 4 feet in size and weighing about 80 pounds. As shown, the heavy bag is suspended from overhead by means of straps 22, one end of each which are sewn to the exterior of the heavy bag and the other end to a chain.

Figure 2:
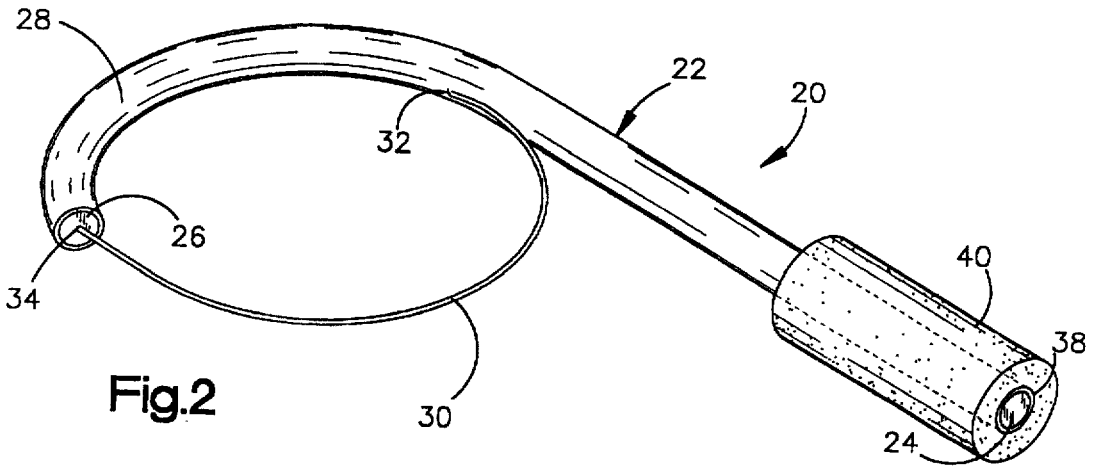
FIG. 2 is a perspective view of one embodiment of a training device according to the present invention.

The training device 20 of the present invention as shown in FIG. 2 is comprised of an elongated tubular member 22 having a first distal portion 24 and a second distal portion 26. The tubular member 22 has a first arcuate bend 28 disposed between the first and second distal portions. The first arcuate bend 28 is designed to matingly engage the exterior of a heavy bag (not shown) along at least a portion of the circumference of the bag.

The training device 20 is further comprised of an elastomeric member 30 having opposed ends 32 and 34 fixed to the tubular member on opposite sides of the first arcuate bend 28 so as to define an aperture 36 therewith for attaching the training device to the heavy bag. The elastomeric member 30 and the first arcuate bend 28 of the tubular member 22 are in contact with the exterior of the heavy bag along the circumference of the heavy bag securing the tubular member to the bag via frictional engagement between elastomeric member, the first arcuate bend, and the heavy bag minimizing relative movement between the tubular member and the bag. The training device, when attached to the heavy bag, simulates a human arm. At least a portion of the tubular member is encased in resilient covering material 38. Preferably, the entire tubular member is encased in a resilient covering material.

In a preferred embodiment, the training device is suitably comprised of a resilient pad 40 secured to one of the distal portions. Preferably, the resilient pad is secured to the first distal portion 24. The resilient pad is secured to the distal portion by the friction between the resilient pad and the first distal portion 24, although adhesive may be used if desired.

Figure 3:
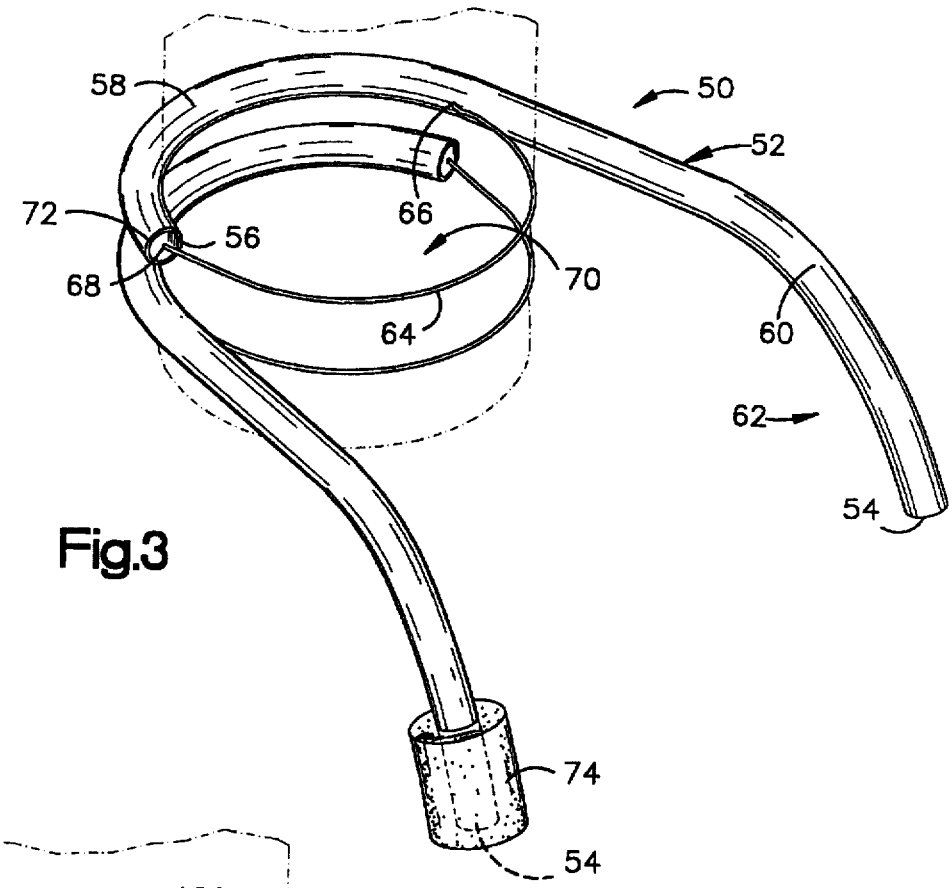
FIG. 3 is a perspective view of a second embodiment of a training device according to the present invention.

In a second embodiment of the training device of the present invention as shown in FIG. 3, the training device 50 is comprised of an elongated tubular member 52 having a first distal portion 54 and a second distal portion 56. The tubular member 52 has a first arcuate bend 58 between the first and second distal portions. The first arcuate bend 58 is designed to matingly engage at the exterior of the heavy bag (not shown) along at least a portion of the circumference of the bag while permitting the tubular member to freely swing back and forth.

The tubular member 52 further comprises a second arcuate bend 60 along a first portion 62 of the tubular member. The first portion 62 of the tubular member is disposed between the first arcuate bend 58 and the first distal portion 54. The second arcuate bend 60 is not adapted to be in contact with the heavy bag. The second arcuate bend is suitably in a plane generally parallel or perpendicular to the plane of the first arcuate bend. Preferably, the second arcuate bend is in a plane generally perpendicular to the plane of the first arcuate bend.

The training device further comprises an elastomeric member 64 having opposed ends 66 and 68 fixed to the tubular member 52 on opposite sides of the first arcuate bend 58 so as to define an aperture 70 therewith for attaching the training device to the heavy bag. The elastomeric member 64 and the first arcuate bend 58 of the tubular member are in contact with the exterior of the heavy bag along the circumference of the heavy bag securing to the heavy bag via frictional engagement between the elastomeric member, the first arcuate bend, and the heavy bag minimizing relative movement between the tubular member and the bag. The training device, when attached to the heavy bag, simulates a human. At least a portion of the tubular member 52 is encased in a resilient covering material 72. Preferably, the entire tubular member is encased in a resilient covering material.

In a preferred embodiment, the training device is comprised of a resilient pad 74 secured to one of the distal portions. Preferably, the resilient pad is secured to the first distal portion 54. The resilient pad is secured to the distal portion by any known means, but preferably by merely slipping the resilient pad over the distal portion and allowing the relative friction between the resilient pad and the distal portion to maintain the resilient pad in place.

Figure 4:
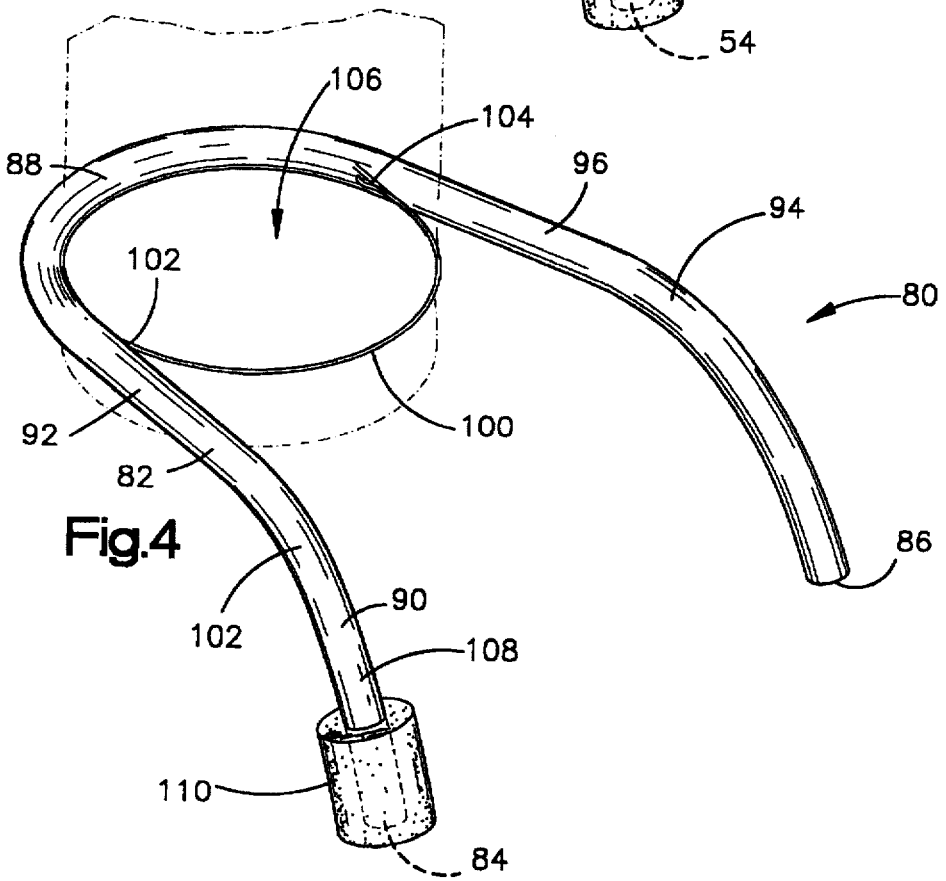
FIG. 4 is a perspective view of a third embodiment of a training device according to the present invention.

In a third embodiment of the present invention as shown in FIG. 4, the training device 80 is comprised of an elongated tubular member 86 having a first distal portion 84 and a second distal portion 86. The tubular member has a first arcuate bend 88 disposed between the first and second distal portions. The first arcuate bend 88 is designed to matingly engage the exterior of a heavy bag (not shown) along at least a portion of a circumference of the heavy bag.

The tubular member comprises a second arcuate bend 90 along a first portion 92 of the tubular member disposed between the first arcuate bend 88 and the first distal portion 84. The second arcuate bend 90 is not adapted to be in contact with the heavy bag. The second arcuate bend 90 is suitably in a plane generally parallel or perpendicular to the plane of the first arcuate bend 88. Preferably the second arcuate bend is in a plane generally perpendicular to the first arcuate bend. The tubular member 82 further comprises a third arcuate bend 94 along a second portion 96 of the tubular member. The second portion 96 is disposed between the first arcuate bend 88 and the second distal portion 86. The third arcuate bend 94 is not adapted to be in contact with the heavy bag.

The training device further comprises an elastomeric member 100 having opposed ends 102 and 104 fixed to the tubular member 82 on opposite sides of the first arcuate bend 88 so as to define an aperture 106 therewith for attaching the training device to the heavy bag. The elastomeric member 100 and the first arcuate bend 88 of the tubular member are in contact with the exterior of the heavy bag along the circumference of the heavy bag securing the tubular member to the heavy bag via friction of engagement between the elastomeric member, the first arcuate member, and the heavy bag minimizing relative movement between the tubular member and the heavy bag, while permitting the tubular member to swing about freely, especially in response to a hit or kick. At least a portion of the tubular member 86 is encased in a resilient material covering material 108. Preferably the entire tubular member is encased in a resilient covering material.

In a preferred embodiment, the training device is comprised of a resilient pad 110 secured to one of the distal portions. Preferably, the resilient pad is secured to the first distal portion 84. The resilient pad is secured to the distal portion by any known means.

The diameter of the tubular member is any suitable diameter which will permit the user of the device to focus punches and kicks onto the device. Preferably, the diameter of the device is about 2" to 4". The circumference of the first arcuate bend is any suitable circumference such that the first arcuate bend will engage the exterior of the heavy bag along at least a portion of the circumference of the bag. Preferably, the circumference of the first arcuate bend is similar to the circumference of the heavy bag used in connection with the training device in order to minimize relative movement between the bag and the tubular member. The length of the tubular member disposed between the first arcuate bend and first distal portion is any suitable length which will permit the user of the device to focus punches and kicks onto the device. The circumference of the second arcuate bend in the second and third embodiment of the present invention is any suitable circumference such that such second arcuate bend simulates a human leg bent at the knee and permits the user to focus punches and kicks at the device. The circumference of the third arcuate bend is any suitable circumference.

The length of the elastomeric member is any suitable length such that the elastomeric member defines an aperture of sufficient size to secure the tubular member to the bag and minimize relative movement between the tubular member and the bag. Preferably, the elastomeric member is about 16" to about 19" in length.

The tubular member is comprised of any suitable materials which will withstand repeated hits from the participant. Preferably, the tubular member is polyvinyl chloride pipe.

The elastomeric member is any suitable material which has sufficient elastic properties to adequately secure the tubular member to the heavy bag. Suitable materials are typically referred to as elastic stretch cord. Preferably, the elastomeric member is polypropylene.

The resilient covering material is any suitable material which will protect the tubular member from repeated hits and will cushion the tubular member reducing injury to the participant. Suitable materials include, but are not limited to, vinyl nitro plastizol, polyurethane, urethane, neoprene, polyethylene, purethane and combinations thereof. Preferably the resilient coveting material is polyurethane.

The resilient pad is any suitable material which will protect the tubular member from repeated hits and will cushion the tubular member reducing injury to the participants. Suitable materials include, but are not limited to, vinyl nitrate, EPDM, CPE and sueded foam. Preferably, the resilient covering material is sueded foam.

The training device of the present invention is produced by bending a generally cylindrical elongated tubular member having first and second distal portions so as to form a first arcuate bend which will matingly engage the exterior of a heavy bag along at least a portion of the circumference of the heavy bag. An elastomeric member having opposed ends is fastened to the tubular member on opposite sides of the first arcuate bend to define an aperture for securing the training device to the heavy bag.

In the second embodiment, the tubular member is further bent to produce a second arcuate bend disposed between the first arcuate bend and the first distal portion. The second arcuate bend is not adapted to be in contact with the heavy bag.

In a third embodiment, the tubular member is further bent to produce a third arcuate bend disposed between the first arcuate bend and the second distal portion. The third arcuate bend is not adapted to be in contact with the heavy bag.

A resilient covering material is affixed to at least a portion of the tubular member. The training device is secured to the heavy bag by contacting the elastomeric member and the first arcuate bend with the heavy bag securing the training device to the heavy bag via frictional engagement between the elastomeric member and the first arcuate portion and the heavy bag, minimizing the relative movement between the tubular member and the bag.

As to the manner of usage and operation of the present invention, the participant selectively contacts the resilient cover training device focusing punches and kicks onto the device. The training device of the present invention allows those training in the martial arts, boxing, or wrestling or merely engaging in physical fitness training to sharpen their skills by practicing punches and kicks on simulated opponent, increasing the quality of their training. The participant can practice punches and kicks to a simulated arm or leg without the assistance of another person, thereby avoiding risk of injury to the other person. In addition, the resilient covering and pad provide added safety as such resilient cover and pad cushion the tubular member reducing injury to the participant when striking the device. Further the training device is easily attached or detached from the heavy bag allowing the participant to use the device with any suitable bag.

While various embodiments of a training device and method useful for training in the martial arts have been disclosed, it should be understood that modifications and adaptations thereof will occur to persons skilled in the art. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

Having thus described the invention, it is claimed:

1. A training kit comprising:

a generally cylindrical heavy bag adapted to be suspend from one end thereof;

an elongated tubular member having first and second distal portions, wherein the tubular member has a first arcuate bend matingly engagable to an exterior of the heavy bag along an exterior circumference thereof;

an elongated elastomeric member having opposed ends fixed to the tubular member on opposite sides of the first arcuate bend so as to define an aperture therewith, whereby the elastomeric member is adapted to frictionally secure the tubular member to the exterior of the heavy bag along the exterior circumference; and a resilient cover disposed about at least a portion of the elongated tubular member.

2. The training device of claim 1 further comprising at least one resilient pad being secured to at least one of the distal ends.

3. The training device of claim 1 wherein the elongated tubular member includes at least a second arcuate bend along a first portion thereof not generally in contact with the bag, the first portion being disposed between the first arcuate bend and the first distal portion.

4. The training device of claim 1 wherein the elongated tubular member includes at least a third arcuate bend along a second portion thereof not contacting the bag, the second portion being disposed between the first arcuate bend and the second distal portion.

5. The training device of claim 1 wherein the second arcuate bend extends in a plane generally perpendicular to a plane generally defining the first arcuate bend.

6. The training device of claim 1 wherein the second arcuate bend extends in a plane generally parallel to a plane generally defining the first arcuate bend.

7. The training device of claim 3 wherein the elongated tubular member includes at least a third arcuate bend along a second portion thereof not contacting the bag, the second portion being disposed between the first arcuate bend and the second distal portion.

8. The training device of claim 6 wherein the third arcuate bend extends generally in a plane generally parallel to a plane of the first arcuate bend.

9. A training Kit comprising:

a generally cylindrical heavy bag adapted to be suspended from one end thereof;

an elongated tubular member having first and second distal portions, wherein the tubular member has a first arcuate bend;

an elongated elastomeric member having opposed ends fixed to the tubular member on opposite sides of the first arcuate bend so as to define an aperture therewith; and a resilient cover disposed about at least a portion of the elongated tubular member.

10. The training device of claim 9 further comprising at least one resilient pad being secured to at least one of the distal ends.

11. The training device of claim 9 wherein the elongated tubular member includes at least a second arcuate bend along a first portion thereof, the first portion being disposed between the first arcuate bend and the first distal portion.

12. The training device of claim 11 wherein the elongated tubular member includes at least a third arcuate bend along a second portion thereof, the second portion being disposed between the first arcuate bend and the second distal portion.

13. The training device of claim 11 wherein the second arcuate bend extends generally in a plane generally perpendicular to a plane of the first arcuate bend.

14. The training device of claim 11 wherein the second arcuate bend extends generally in a plane generally parallel to a plane of the first arcuate bend.

15. The training device of claim 13 wherein the elongated tubular member includes at least a third arcuate bend along a second portion thereof, the second portion being disposed between the first arcuate bend and the second distal portion.

16. The training device of claim 14 wherein the elongated tubular member includes at least a third arcuate bend along a second portion thereof, the second portion being disposed between the first arcuate bend and the second distal portion.

17. The training device of claim 16 wherein the third arcuate bend extends generally in a plane generally perpendicular to the plane of the first arcuate bend.

18. The training device of claim 16 wherein the third arcuate bend extends generally in a plane generally parallel to a plane of the first arcuate bend.

19. A training method comprising:

selectively contacting a resilient cover of an elongated tubular member having first and second distal portions, wherein the tubular member has a first arcuate bend matingly engaged an exterior of a generally cylindrical heavy bag along at least a portion of a circumference thereof, and wherein the tubular member has an elongated elastomeric member having opposed ends fixed thereto on opposite sides of the first arcuate bend so as to define an aperture therewith, whereby the elastomeric member secures the tubular member about the bag by securing the bag via friction to the first arcuate bend so as to minimize relative movement between the bag and the tubular member upon such contact.

20. A method of fabricating a training device comprising the steps of:

bending a generally cylindrical, elongated tubular member having first and second distal portions so as to form a first arcuate bend therein, the first arcuate bend having an interior radius size and configured to matingly engage an exterior of an associated, generally cylindrical heavy bag so as to engage at least a portion of the bag along a circumference thereof;

fastening an elongated elastomeric member having opposed ends to the tubular member on opposite sides of the first arcuate bend so as to define an aperture therewith, whereby the elastomeric member is adapted to secure the tubular member about the bag by securing the bag via friction to the first arcuate bend; and affixing a resilient cover so as to be disposed about at least a portion of the elongated tubular member which is configured to be contacted by a user when training with the devices.

* * * * *